US008333281B2

(12) United States Patent
Saltsov

(10) Patent No.: US 8,333,281 B2
(45) Date of Patent: Dec. 18, 2012

(54) MEDICATION CASSETTE SYSTEM

(76) Inventor: Leon Saltsov, Thornhill (CA)

( * ) Notice: Subject to any disclaimer, the term of this patent is extended or adjusted under 35 U.S.C. 154(b) by 0 days.

(21) Appl. No.: 12/998,617

(22) PCT Filed: Dec. 9, 2009

(86) PCT No.: PCT/CA2009/001785

§ 371 (c)(1),
(2), (4) Date: May 9, 2011

(87) PCT Pub. No.: WO2010/066035

PCT Pub. Date: Jun. 17, 2010

(65) Prior Publication Data

US 2011/0231006 A1 Sep. 22, 2011

(30) Foreign Application Priority Data

Dec. 9, 2008 (CA) ..... 2646029

(51) Int. Cl.
*B65D 83/04* (2006.01)
*B65D 85/00* (2006.01)
*B65D 43/20* (2006.01)

(52) U.S. Cl. ..... 206/539; 206/1.5; 206/459.5; 206/534; 220/348

(58) Field of Classification Search ..... 206/1.5, 206/38, 38.1, 534, 538, 539, 459.5; 220/345.1–345.6, 507, 523, 524
See application file for complete search history.

(56) References Cited

U.S. PATENT DOCUMENTS

| | | | | |
|---|---|---|---|---|
| 2,367,019 | A * | 1/1945 | Haag | 206/539 |
| 2,605,892 | A * | 8/1952 | Waber et al. | 220/345.4 |
| 3,033,355 | A * | 5/1962 | Van Sickle | 206/539 |
| 3,833,143 | A * | 9/1974 | Starkermann et al. | 206/538 |
| 6,341,710 | B1 * | 1/2002 | Danielson et al. | 220/345.3 |
| 6,789,677 | B2 * | 9/2004 | Maietta | 206/1.5 |
| 7,451,876 | B2 * | 11/2008 | Bossi et al. | 206/534 |
| 7,464,819 | B2 * | 12/2008 | Maietta | 206/1.5 |
| 7,757,843 | B2 * | 7/2010 | Katsis | 206/1.5 |
| 2006/0006091 | A1 * | 1/2006 | Maietta | 206/539 |
| 2006/0054682 | A1 * | 3/2006 | de la Huerga | 235/375 |
| 2010/0133140 | A1 * | 6/2010 | Bailey et al. | 206/538 |

FOREIGN PATENT DOCUMENTS

WO WO 2008004212 A2 * 1/2008

* cited by examiner

*Primary Examiner* — Bryon Gehman

(57) ABSTRACT

A medication cassette uses a slidable core having a series of open top medication receiving cells extending in a length thereof. The core slides in an outer sleeve and includes a releasable locking arrangement for maintaining the core in a lock position with the sleeve closing the cells and movable to a release position allowing the core to slide relative to the sleeve. The release position allows the cells to be progressively exposed beyond the sleeve to allow medication to be removed. Both the slidable core and the sleeve are preferably made of a plastic material. The core is preferably a single component made by injection molding and the sleeve is preferably made as an extruded component.

18 Claims, 6 Drawing Sheets

MEDICATION CASSETTE SYSTEM

FIELD OF THE INVENTION

The present invention relates to a medication cassette having a series of individual cells for receiving a single dose of a medication. The cassette has particular advantages for receiving medication preferably in the form of pills, tablets or capsules.

BACKGROUND OF THE INVENTION

Various methods have been proposed for individually customizing medication to reduce the possibility of errors in taking of the medication. Every year there are many tragic events where a person's health or life has been put in jeopardy due to the failure to take prescribed medication according to a prescribed protocol.

One solution to this problem includes the preparation of customized blister packaging where this packaging provides a series of different medications to be taken at particular times of the day or week by the user. There are also a number of medication organizing containers that a user fills as part of a manual system. These organizing containers have a series of cells identified for a particular day and a particular time and are typically sized for a week or two week period. Each cell includes a separate lid for accessing of the individual cell and individual medication dosage. These systems assist a user in properly following a prescribed dosage regiment, however these containers require individual filling thereof by the end user and require manipulation of lids to return or remove medication.

Certain automated systems have been proposed for use in a home to also address these problems.

To date, the prior art has tried to address the problems associated with a user taking medication according to a particular time table by providing a system where either the manufacturer, pharmacist or the end user adopts and effectively assumes responsibility for filling of the system.

The present invention proposes a medication cassette that can be used manually by an end user or automatically by a device in the end user's home to control the dosage of medication. The medication cassette can also be used in a traditional manner by a user who manually opens the cassette. This cassette allows an end user, a pharmacy or a manufacturer to preload the cassette for a particular individual.

SUMMARY OF THE INVENTION

A multi-cell medication cassette comprises an outer sleeve and a molded core slidably disposed in the sleeve. The molded core has a plurality of upwardly opening cells for receiving medication. The molded core includes at least one releasable locking tab provided on the molded core and engageable with the outer sleeve for locking the outer sleeve and the molded core in a closed position with the sleeve closing the upwardly opening cells. The at least one releasable locking tab allows the molded core to slide relative to a length of the sleeve to selectively expose and allow loading of any medication into the upwardly opening cells or dispensing of medication from the cells. The molded core preferably includes a machine readable code to provide configuration details of the multi-cell cassette.

According to an aspect of the invention, the molded core is made of a translucent plastic material and preferably the outer sleeve is made of a non-transparent plastic.

In a further aspect of the invention, the molded core is formed such that at least a bottom portion of each upwardly opening cell is translucent to allow optical detection through the bottom portion of any medication in any of the cells.

In a preferred aspect of the invention, the cassette includes a radio frequency identification tag providing at least details of the medication disposed in the cassette.

In a preferred aspect of the invention, the molded core includes a series of rows of said upwardly opening cells and each row is uniquely identified and has sufficient cells for dispensing of the medication for a specified period.

In yet a further aspect of the invention, the molded core includes at least four rows of cells and each row of cells includes at least fourteen cells.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
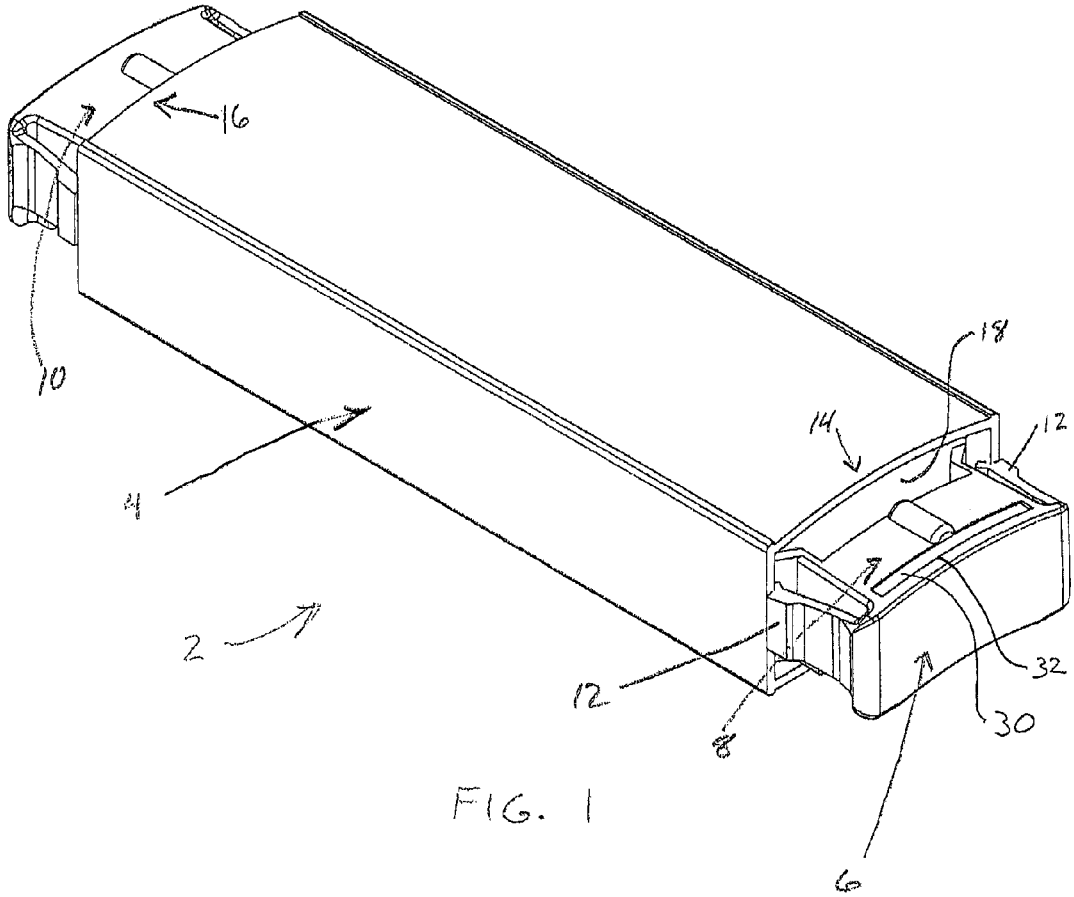
FIG. 1 is a perspective view of the medication cassette in a closed position thereof.

The multi-cell medication cassette 2 is shown in FIG. 1 and includes an outer sleeve 4 that slidably receives the molded core 6. The molded core 6 is of a length greater than the sleeve 4 with the molded core 6 projecting beyond the ends of the sleeve 4. As shown in FIG. 1, ends 8 and 10 of the molded core 6 are exposed beyond the outer sleeve 4.

Figure 2:
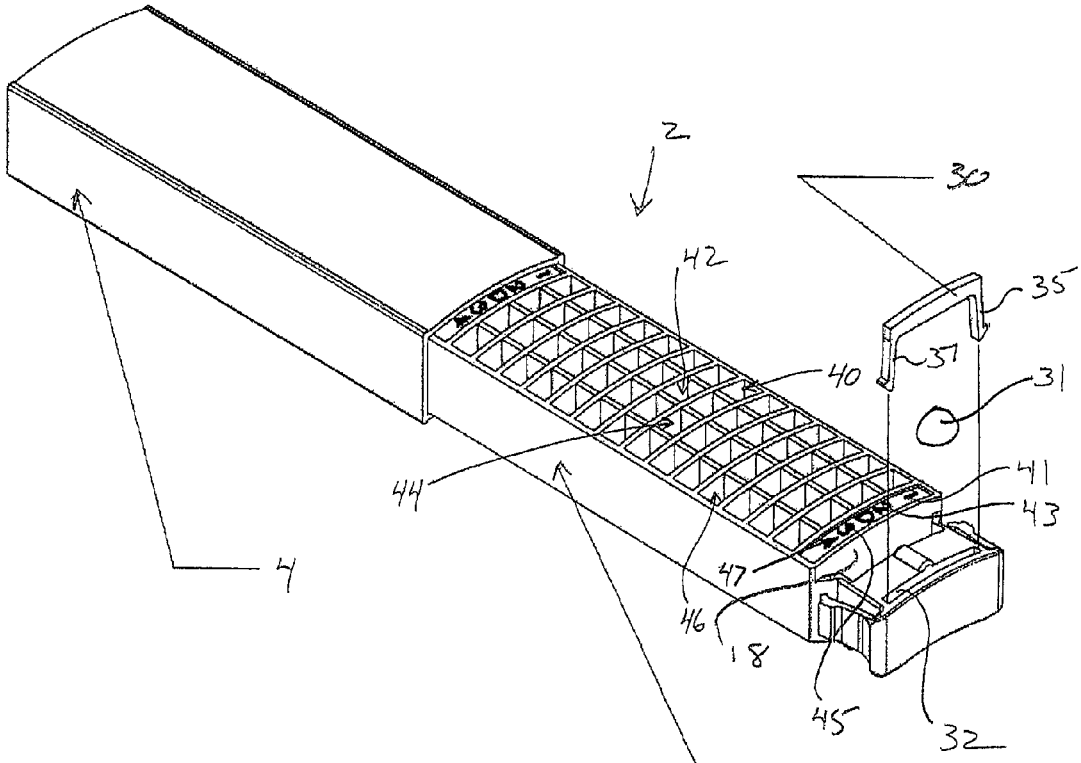
FIG. 2 is a perspective view of the medication cassette in an open position thereof.

Ends 8 and 10 of the molded core 6 each include a pair of spring arms 12 that are biased to engage the ends 14 or 16 of the outer sleeve 4. A user or a machine can engage the spring arms 12 and move the same towards each other to allow the spring arms to move into the outer sleeve 14. In this way, the molded core 6 can be slidably displaced in the outer sleeve 4 to allow accessing of the individual cells of the molded core as indicated in FIG. 2 for loading of the cells or dispensing of any medication in the cells. Preferably the dispensing of any medication is gravity dispensing out of the cells by inverting the medication cassette.

In the preferred medication cassette 2 of FIG. 1, it can be seen that each of the ends 8 and 10 of the molded core 6 include the spring arms 12 and as such the molded core can be released to allow sliding movement in either direction along the length of the outer sleeve 4.

A preferred molded core 6 is shown in FIG. 2 that includes four rows (40, 42, 44 and 46) of open top cells. These individual rows are identified at the ends of the molded core by means of the indicia labeled as 41, 43, 45 and 47. These indicia are 1, 2, 3 and 4. These indicia are also provided at the opposite end of the molded core 6 to avoid possible misidentification by an end user. The molded core 6 of FIG. 2 has 14 open top cells for each row. This arrangement of 14 open top cells for each row can be used for a single medication taken once a day for a two week period.

FIG. 2 also shows details of a port 32 provided in the ends of the molded core that receives the radio frequency ID tag 31 (RFID). The RFID tag 31 is captured in the port 32 by a plug 30. The plug 30 includes a spring latch arrangement indicated by the two downwardly extending arms 35 and 37 having locking tangs engageable with the port 32. In this way the RFID tag 31 can be appropriately programmed for identification and recognition by a machine and provide details of the medication loaded in the cassette, the prescribing doctor, the name of the patient, the dosage, the prescription date, the expiration date of the medication and other information. The RFID tag can also track current information such as medication remaining, for example, if an automated dispensing system is used. This coding of the RFID tag 31 may be done by a pharmacy or a manufacturer. Typically the RFID tag 31 will include details of the particular medication loaded into each of the rows of cells and the configuration of the core.

Figure 3:
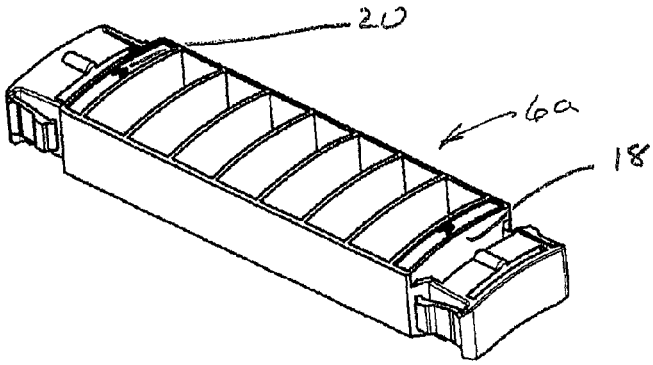
FIG. 3 is a perspective view of a molded core having a single row of open cells.
Figure 4:
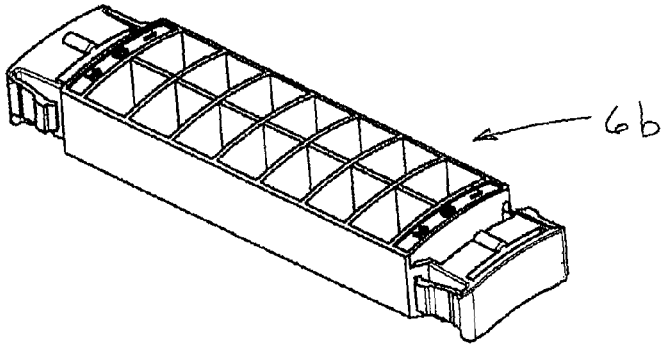
FIG. 4 is a perspective view of the molded core where two rows of cells are provided.

FIGS. 3 through 6 show four different molded cores. FIG. 3 shows a molded core having a single row of open cells and this molded core may be used for medication dosages which are of a large size. The molded core of FIG. 4 includes two rows of cells and each row includes 7 cells. Each row of cells is appropriately identified at opposite ends of the molded core. It is also noted that the molded core of FIG. 3 includes seven cells disposed in a single row.

Figure 5:
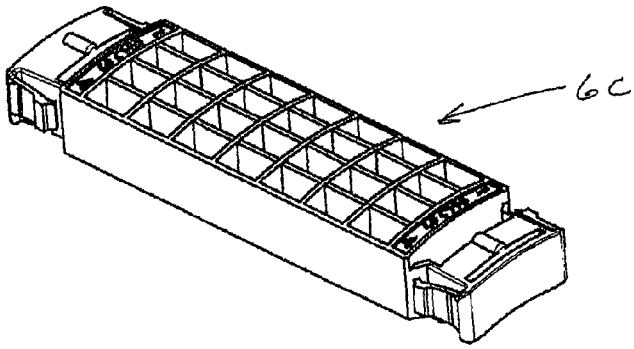
FIG. 5 is a perspective view of the molded core where the molded core includes four rows of cells.

The molded core of FIG. 5 includes four rows of cells, each uniquely identified, and each row of cells includes seven cells.

Figure 6:
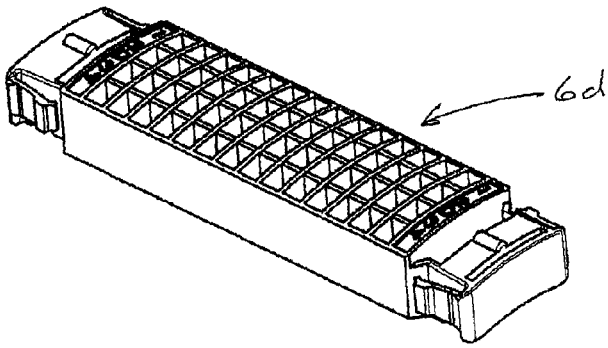
FIG. 6 is a perspective view of a molded core having four rows of cells and each row includes at least fourteen cells.

The molded core of FIG. 6 includes four rows, each uniquely identified, however each row includes 14 cells. It is preferred that the cells are in multiples of seven cells per row to correspond with the number of days in a week. The molded core of FIG. 6 can be used with medication of a relatively small size where each cell receives one pill, capsule or tablet.

Given that the medication cassette 2 can receive molded cores of different capacities, it is desirable to be able to automatically determine which molded core is provided in the medication cassette. This is particularly useful for the automatic loading or dispensing of the medication within the cassette and the cores can be distinguished by sensing as will be more fully described.

Figure 7:
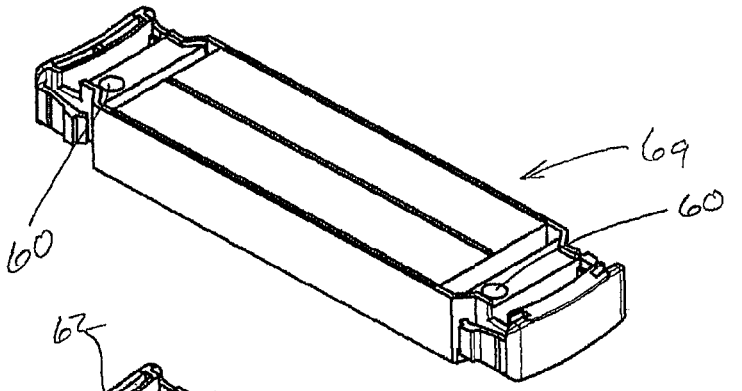
FIG. 7 is a bottom perspective view of the molded core of FIG. 3.
Figure 8:
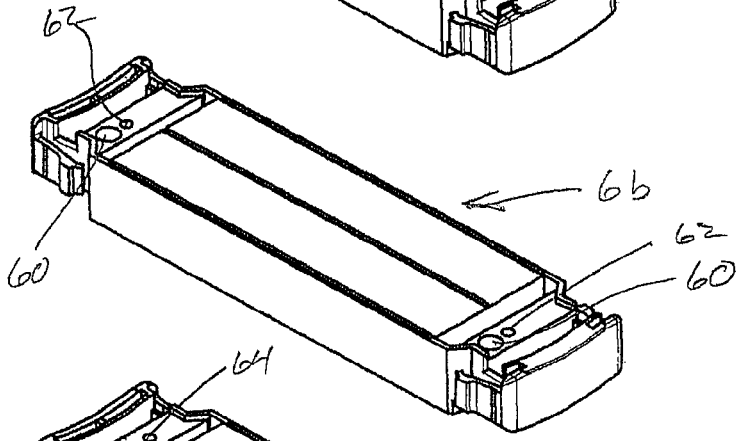
FIG. 8 is a bottom perspective view of the molded core of FIG. 4.
Figure 9:
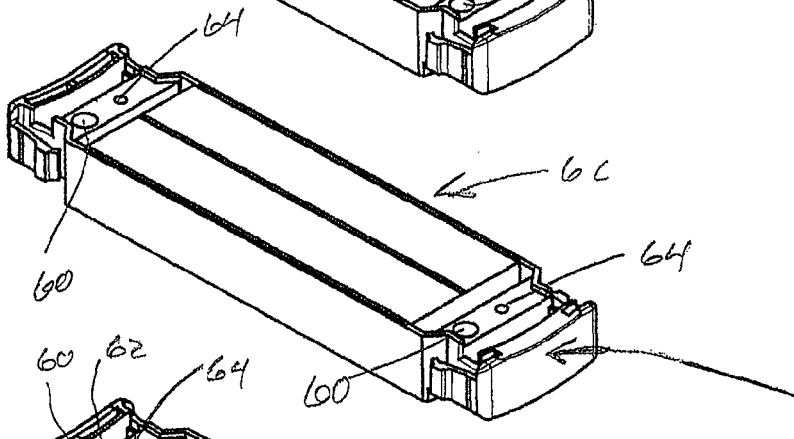
FIG. 9 is a bottom perspective view of the molded core of FIG. 5.

The bottom views of FIGS. 7 through 9 illustrate how each of these molded cores 6 is uniquely marked. The molded core 6*a* includes a large identifying tag 60 located at each end of the core. Preferably this is an optical tag that, when exposed to a light source, will reflect the light. By providing a tag at each end of the molded core it simplifies the design of any automated device that loads the molded core or receives the cassette with medication already loaded therein. These tags 60 can be used to determine orientation of the cassette. In an end user machine, the user may not insert the cassette in a particular orientation. Typically the cassette is longitudinally received within an automated machine, however whether end 8 is first inserted or end 10 is first inserted can be a problem. It is possible to make the medication cassette such that it can only be loaded in a single direction, however this may create problems for an end user in loading such a device. It is therefore preferable to make the cassette receivable in an automated machine in either direction. By providing tags 60, the orientation of the molded core can be determined. In addition, if only the single tag 60 is present the core is a single row, 7 cell core.

The molded core 6*b* of FIG. 8 not only includes the tags 60 but also tags 62 at either end of the cassette. Sensors in the automatic filling machines and/or the automatic dispensing machines, can sense the tags 60 and 62. When both tags are present in the illustrated or predetermined locations the device will recognize the molded core 6*b* as including two rows of open cells.

In the molded core 6*c* of FIG. 9, again two identification tags are shown as 60 and 64. Identification tag 64 is not immediately adjacent tag 60 as would be the case in FIG. 8. The tag 64 is offset and is generally in a position that would align with the second row of cells. This unique positioning allows detection of this type of core relative to the cores 6*a* and 6*b*, and thus allows automatic identification of a four row, seven cell molded core of FIG. 5.

Figure 10:
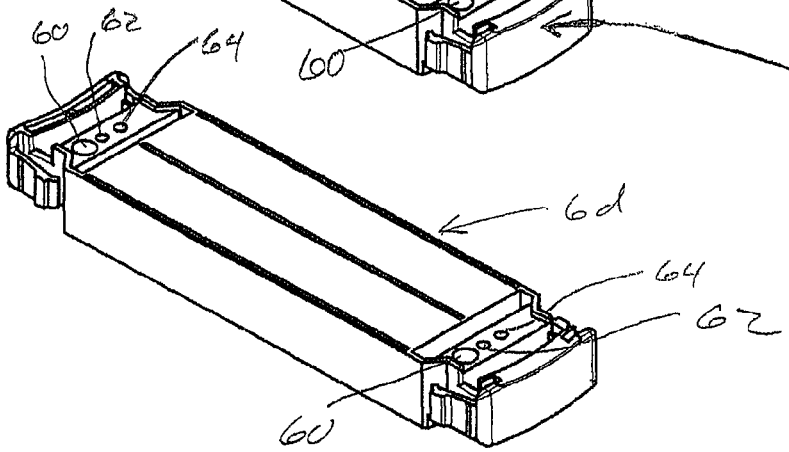
FIG. 10 is a bottom perspective view of the molded core of FIG. 6.
Figure 11:
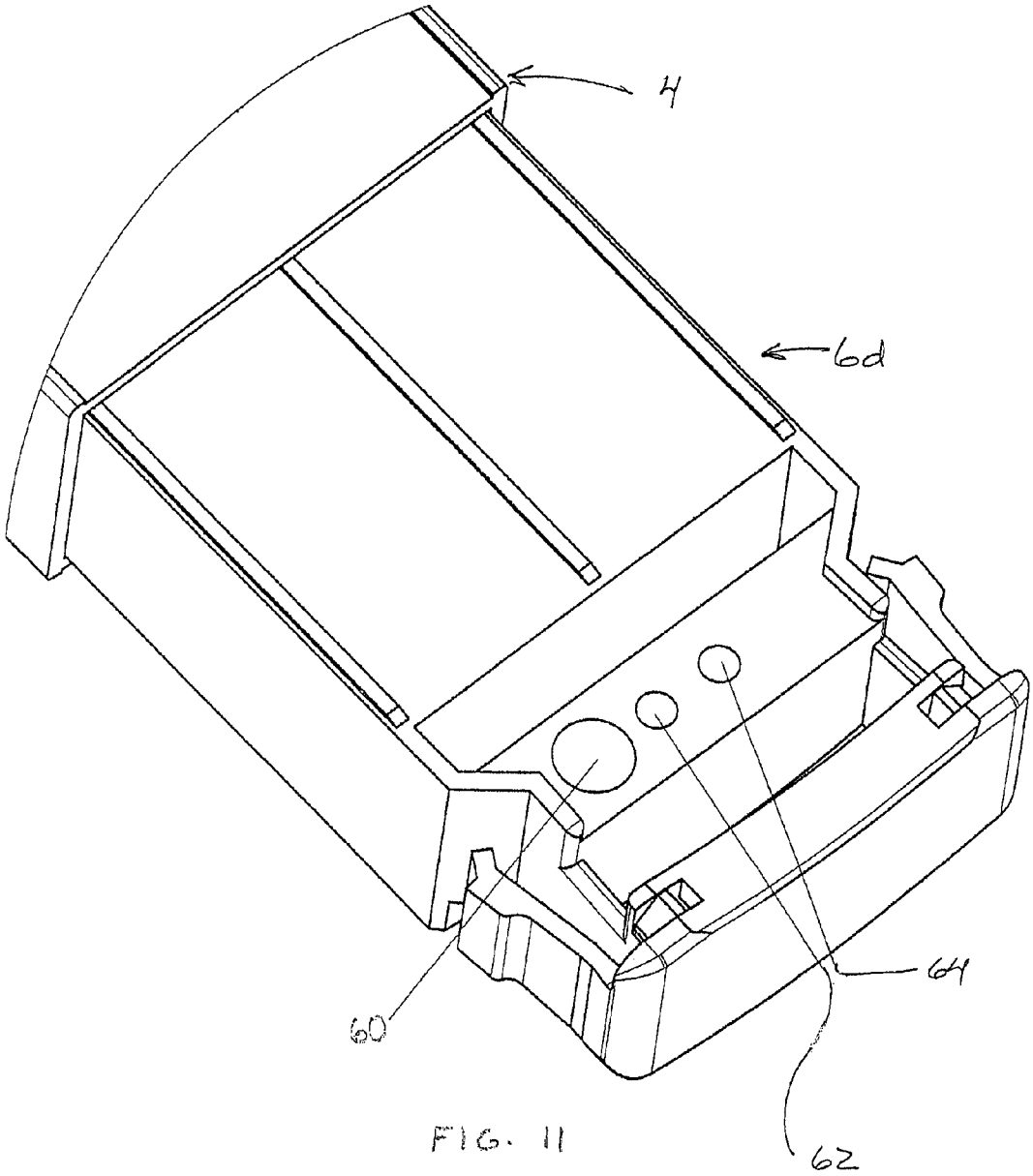
FIG. 11 is a partial bottom perspective view of the medication cassette where the molded core corresponds to the structure of FIG. 10.
Figure 12:
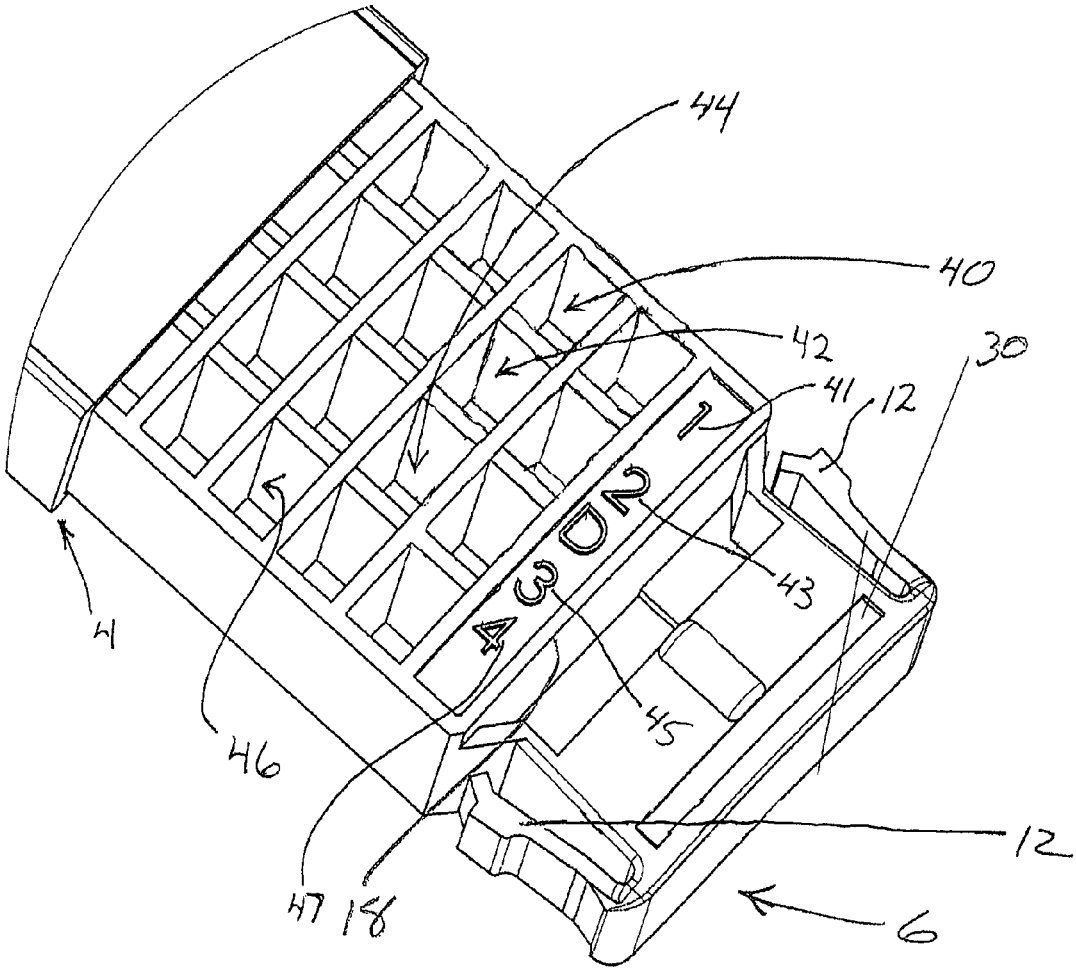
FIG. 12 is a top perspective view of the medication cassette where the molded core is of the structure as shown in FIG. 6.

In FIG. 10 three tags 60, 62 and 64 are provided at opposite ends of the molded core 6*d*. The presence of all three tags uniquely identifies the molded core of FIG. 6 having four rows and 14 cells per row. As can be appreciated, the visual indicia 41, 43, 45 and 47 simplify the process for an end user who wishes to use the medication cassette in a manual manner for accessing the medication.

The tags 60, 62 and 64 can be optical lenses with a bottom reflective surface to allow the reflection of light. These provide a simple solution where the automatic sensing is concentrated in the automatic dispensing machine of an end user or an automatic loading machine of a pharmacist or a manufacturer. Other suitable arrangements can be used for the tags, however optical reflective tags are preferred as being low cost and reliable.

The molded core is preferably an injection molded plastic that is translucent. The clear plastic of the cores allow scanning of pills through the bottom of the individual cells to confirm that the medication has been appropriately filled and is located within the individual cells.

It is noted that the ends of the molded cores project beyond the sleeve, however each molded core includes intermediate end walls 18 and 20 which cooperate with the sleeve to effectively close the individual cells when the medication cassette is in the closed position of FIG. 1.

In automated machines for loading of the medication cassette and/or dispensing of medication within the cassette, a plurality of such medication cassettes are typically included. Various arrangements for determining of the particular medication and dispensing protocol can be provided on a cassette. The one example is the RFID tag that is insertable within a recess in an end wall of the cassette. A further approach is a bar code label that can be provided on an exposed side of the sleeve. This bar code is machine readable and an appropriate coding scheme can be provided for providing of the information. The sleeve of the medication cassette provides a large label receiving surface area for presenting information allowing an end user to basically read the prescription details and the details of the location of the medication within the molded core.

The medication cassette as described herein is suitable for use by an end user in a manual manner however it is also suitable for use by a pharmacist or a manufacturer to allow loading of the medication cassette using automated equipment. It is also possible for a pharmacist to manually load the medication cassette much in the manner that an end user may separately load the cassette. Designing the cassette such that it is usable in both a manual and an automated manner allows a user to initially become familiar with the cassette that may be automatically filled by a pharmacist where the user accesses the medication manually. At a later point in time, for example if the end user is having problems dispensing the medication, an automatic dispensing arrangement for the end user's home could be used. This automatic dispensing arrangement assists in automating and reminding the end user of the need to take a particular medication and dispensing the medication in a simplified manner. The end user may still be required to load such medication cassettes into the automated device, however his familiarity with this and the ability for the machine to determine which way the cassette has been loaded reduces problems. At a different point in time, the actual end user may merely use the automated device where another person has effectively loaded the device for the end user.

The medication cassette as shown in the drawings illustrates the various different configurations of the cassette that are possible without changing the physical dimensions of the cassette. In the preferred embodiments a single row 7 cell molded core has been used and in a higher capacity embodiment a 4 row 14 cell core has been illustrated. As can readily be appreciated, it is possible to vary the configuration of the molded core for particular applications. With the present system it is desirable to maintain the overall size of the cassette and accommodate different capacities by providing more rows and cells within the molded core. By maintaining a particular physical size of the cassette and modifying the molded core, simplifications are possible with the automation for filling of the medication into the molded core as well as for automatic dispensing of the medication in a user's home.

The use of the molded cassette with other portions such as the RFID tag or bar code or other machine recognizable code provided on the cassette, it is possible that a common dispensing device located in a user's home is suitable for multiple users. This can be accomplished by replacing one cassette with a different cassette where the device is able to recognize the particular patient that is to receive the medication. With the present invention, the molded cassette can include machine recognizable identification of the intended users, the particular medications provided in the molded core, and the dispensing regime. As can be appreciated from the above, the medication cassette can receive different medications in each row of the cassette with each row of the cassette having a common number of cells. This arrangement again simplifies the dispensing (either automatic or manual) by the end user where different types of medication at different points in time are required.

Although the preferred embodiment has described different molded cores with the largest capacity core having 4 rows and 14 cells, other configurations and capacities are possible. This particular 4 row 14 cell is preferred as it provides a manageable size of cassette, but other configurations and larger capacities are easily produced, and the present invention is not limited to the particular embodiments described in the Detailed Description.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A multi-cell medication cassette comprising an outer sleeve and a molded core slidable within said sleeve and having a plurality of upwardly opening cells for receiving medication, said molded core including opposed pairs of releasable locking tabs provided on opposite ends of said molded core and engageable with end portions said outer sleeve on opposite sides thereof for locking said outer sleeve and said molded core in a closed position with said sleeve closing said upwardly opening cells and releasable to allow said molded core and locking tabs to slide into said sleeve to selectively expose and allow dispensing of any medication in said upwardly opening cells;

said molded core includes a machine readable code providing configuration details of said multi-cell cassette including the number of rows of cells extending in a length of said core between said ends of said core; and wherein said molded core includes at least two rows of cells and said machine readable code is provided in a bottom surface of said molded cassette adjacent an end thereof and exposed beyond sleeve when said molded core is in said closed position.

2. A multi-cell medication cassette as claimed in claim 1 wherein said molded core is made of a translucent material.

3. A multi-cell medication cassette as claimed in claim 1 wherein at least a bottom portion of each upwardly opening cell is translucent to allow optical detection through said bottom portion of any medication in said cell.

4. A multi-cell medication cassette as claimed in claim 1 wherein said cassette includes a radio frequency identification (RFID) tag; said RFID tag being received and retained in one of the ends of said molded core.

5. A multi-cell medication cassette as claimed in claim 4 wherein said RFID tag includes details of one or more medications and specific cell locations thereof in said multi-cell core.

6. A multi-cell medication cassette as claimed in claim 5 wherein said RFID tag is a separate insert received in a molded port at one end of said multi-cell core.

7. A multi-cell medication cassette as claimed in claim 6 wherein said multi-cell core includes indicia molded into said molded core clearly identifying each row of cells.

8. A multi-cell medication cassette as claimed in claim 1 wherein said machine readable code includes optical tags positioned to identify the orientation of and cell configuration of the molded core.

9. A multi-cell medication cassette as claimed in claim 8 wherein each optical tag includes an optical reflecting lens exposed in an end of said molded core for receiving and reflecting a sensing light beam.

10. A multi-cell medication cassette as claimed in claim 9 wherein said optical tags are provided at both ends of said molded core.

11. A multi-cell medication cassette as claimed in claim 8 wherein said optical tags are positioned to distinguish between three or more different cell configurations of said molded core.

12. A medication cassette comprising an outer sleeve releasably receiving a slidable core having a series of open topped cells for receiving medication;

said slidable core including opposed ends with each opposed end including a pair of opposed spring arms provided on the sides of the slidable core and movable between a lock position and a release position;

said spring arms in said lock position engaging side edges of said sleeve at opposite ends thereof restricting movement of said core within said sleeve with said sleeve closing said open topped cells and the ends of said core each extending beyond the ends of said sleeve;

each spring arm in said release position is receivable in said sleeve allowing sliding movement of said core relative to said sleeve to progressively position said open topped cells beyond said sleeve and allow removal of any medication within said cells; and wherein each spring arm when moved to said release position moves inwardly into a side recess in the respective end of said core to allow said spring arm and end of said core to enter said sleeve;

said core when said sleeve is in said lock position and including an exposed machine readable identifier providing details of the contents and location of medication within the cells.

13. A medication cassette as claimed in claim 12 wherein each spring arm is cantilevered and has one end thereof connected to the end of said core with an opposite end of the spring arm angled outwardly and movable inwardly towards said core against said spring bias to said release position.

14. A medication cassette as claimed in claim 13 wherein said core is of a length greater than a length of said sleeve whereby said core in said lock position of said lock arrangements extends beyond said sleeve either end of said core and includes a labeling area on at least one of said ends including a label identifying the contents of the medication cassette.

15. A medication cassette as claimed in claim 14 wherein said core includes a series of rows of cells extending between the ends of said core.

16. A medication cassette as claimed in claim 15 including machine readable code providing information specific to medication loaded in said core and patient information.

17. A medication cassette as claimed in claim 12 wherein said sleeve is a plastic extruded member of an opaque plastic, and said core is of an injection molded plastic construction, and said core is made of a translucent plastic allowing visual detection of medication in any of said cells when exposed beyond said sleeve.

18. A medication cassette as claimed in claim 12 including an RFID tag received and retained in a cavity of said molded core providing information specific to one or more medications loaded in said cells.

* * * * *